US006758272B2

(12) United States Patent
Bixenman et al.

(10) Patent No.: US 6,758,272 B2
(45) Date of Patent: Jul. 6, 2004

(54) APPARATUS AND METHOD FOR OBTAINING PROPER SPACE-OUT IN A WELL

(75) Inventors: Patrick W. Bixenman, Bartlesville, OK (US); Ezio Toffanin, Brussels (BE)

(73) Assignee: Schlumberger Technology Corporation, Sugar Land, TX (US)

( * ) Notice: Subject to any disclaimer, the term of this patent is extended or adjusted under 35 U.S.C. 154(b) by 7 days.

(21) Appl. No.: 10/233,900

(22) Filed: Sep. 3, 2002

(65) Prior Publication Data

US 2003/0141075 A1 Jul. 31, 2003

Related U.S. Application Data

(60) Provisional application No. 60/352,664, filed on Jan. 29, 2002.

(51) Int. Cl.[7] ..... E21B 47/09
(52) U.S. Cl. ..... 166/255.1; 166/65.1
(58) Field of Search ..... 166/65.1, 66, 113, 166/255.1

(56) References Cited

U.S. PATENT DOCUMENTS

| | | | | |
|---|---|---|---|---|
| 3,861,463 A | | 1/1975 | Crowe | |
| 4,628,998 A | | 12/1986 | Akkerman | |
| 4,765,402 A | | 8/1988 | Smith, Jr. | |
| 4,997,384 A | | 3/1991 | Godfrey et al. | |
| 5,020,592 A | * | 6/1991 | Muller et al. | 166/187 |
| 5,370,545 A | | 12/1994 | Laurent | |
| 5,389,003 A | | 2/1995 | Van Steenwyk et al. | |
| 5,450,904 A | | 9/1995 | Galle | |
| 5,820,416 A | | 10/1998 | Carmichael | |
| 5,823,257 A | | 10/1998 | Peyton | |
| 5,967,816 A | | 10/1999 | Sampa et al. | |
| 6,173,773 B1 | * | 1/2001 | Almaguer et al. | 166/255.2 |
| 6,409,219 B1 | | 6/2002 | Broome et al. | |

FOREIGN PATENT DOCUMENTS

| | | |
|---|---|---|
| EP | 0 810 348 A2 | 12/1997 |
| EP | 0 921 267 A2 | 6/1999 |
| GB | 2 360 536 | 3/2001 |

* cited by examiner

*Primary Examiner*—David Bagnell
*Assistant Examiner*—Brian Halford
(74) *Attorney, Agent, or Firm*—Jeffrey E. Griffin; Brigitte Jeffery Echols; John J. Ryberg

(57) ABSTRACT

The present invention provides an apparatus and method for achieving proper space-out of well components. One aspect of the invention utilizes a dummy production string with a sliding measurement device to measure the proper space-out distance.

17 Claims, 3 Drawing Sheets

APPARATUS AND METHOD FOR OBTAINING PROPER SPACE-OUT IN A WELL

CROSS REFERENCE TO RELATED APPLICATIONS

This invention claims the benefit under 35 U.S.C. § 119 to U.S. Provisional Application No. 60/352,664, filed on Jan. 29, 2002.

BACKGROUND OF THE INVENTION

1. Field of Invention

The present invention relates to the field of well completions. More specifically, the invention relates to a device and method for obtaining proper space-out in a well.

2. Related Art

When completing wells, there is a need to achieve a proper spacing, or space-out, between the well components. The space-out can also affect the force or weight applied to certain downhole components that can affect, among other things, proper sealing and proper function of the components.

As an example, it is necessary to perform a wet connect operation in some completions. Such an operation connects a cable or control line (e.g., fiber optic, electrical, hydraulic) contained in an upper string to a cable of same type contained in a lower string that is already part of the permanent completion in the well. Completing the wet connect requires weight to be set down onto the upper string to ensure that the connection is properly made. Likewise, the production string, or final string, that is left in the hole contains pup joints and a tubing hanger. It is necessary to have the right amount of pipe between the tubing hanger and the wet connect so that the appropriate set-down weight can be applied to make up the wet connection with the tubing hanger landed onto the wellhead.

In another example, some other types of completions are performed in two stages (a "two stage completion"). For instance, if a conventional gravel pack completion is run, the lower completion is performed with a seal bore packer as the upper most component in the lower completion string. The upper completion is then run with a seal assembly at the bottom. The upper completion can contain components such as a safety valve, permanent gauges, gas lift mandrels, and other completion jewelry. This application also requires a space out to insure the seals are engaged when the upper completed is landed.

Obtaining the proper space-out is often not difficult when the wellhead lies only a few hundred feet below the rig floor. In such cases, using the wet connect example for illustration purposes, a service string with the wet connect at its lowest point is lowered into the well in a first run into the well, and the wet connection is made with the appropriate set-down weight. With the wet connection completed, the pipe is marked on the rig floor and the service string is pulled from the well. The marking on the pipe enables space-out calculations and some sections of the service string can be replaced with pup joints and the tubing hanger assembly as appropriate. The modified production string is run in the hole in a second run into the well and the tubing hanger lands on the wellhead ensuring that an appropriate set-down weight is set onto the wet connect. This procedure also applies to the case of the two stage completion.

However, when the wellhead is further below the rig floor, a conventional space-out such as the one described above cannot be performed because of high uncertainties in length. Marking the pipe at the surface is insufficient in such a case and will not ensure that the spaceout is correct.

SUMMARY

In general, according to one embodiment, the present invention provides an apparatus and method for achieving proper space-out of well components.

Other features and embodiments will become apparent from the following description, the drawings, and the claims.

BRIEF DESCRIPTION OF THE DRAWINGS

The manner in which these objectives and other desirable characteristics can be obtained is explained in the following description and attached drawings in which.

It is to be noted, however, that the appended drawings illustrate only typical embodiments of this invention and are therefore not to be considered limiting of its scope, for the invention may admit to other equally effective embodiments.

DETAILED DESCRIPTION OF THE INVENTION

In the following description, numerous details are set forth to provide an understanding of the present invention. However, it will be understood by those skilled in the art that the present invention may be practiced without these details and that numerous variations or modifications from the described embodiments may be possible.

As used here, the terms "up" and "down"; "upper" and "lower"; "upwardly" and downwardly"; and other like terms indicating relative positions above or below a given point or element are used in this description to more clearly described some embodiments of the invention. However, when applied to equipment and methods for use in wells that are deviated or horizontal, such terms may refer to a left to right, right to left, or other relationship as appropriate.

The present invention relates generally to apparatuses and methods for obtaining proper space out of components in wells. For ease of description the following discussion of the invention will focus primarily on one example of use of the space out method, namely making a wet connection downhole. However, the present invention is equally applicable to other situations in which proper space out is desired, such as two stage completions and other situations.

Figure 1:
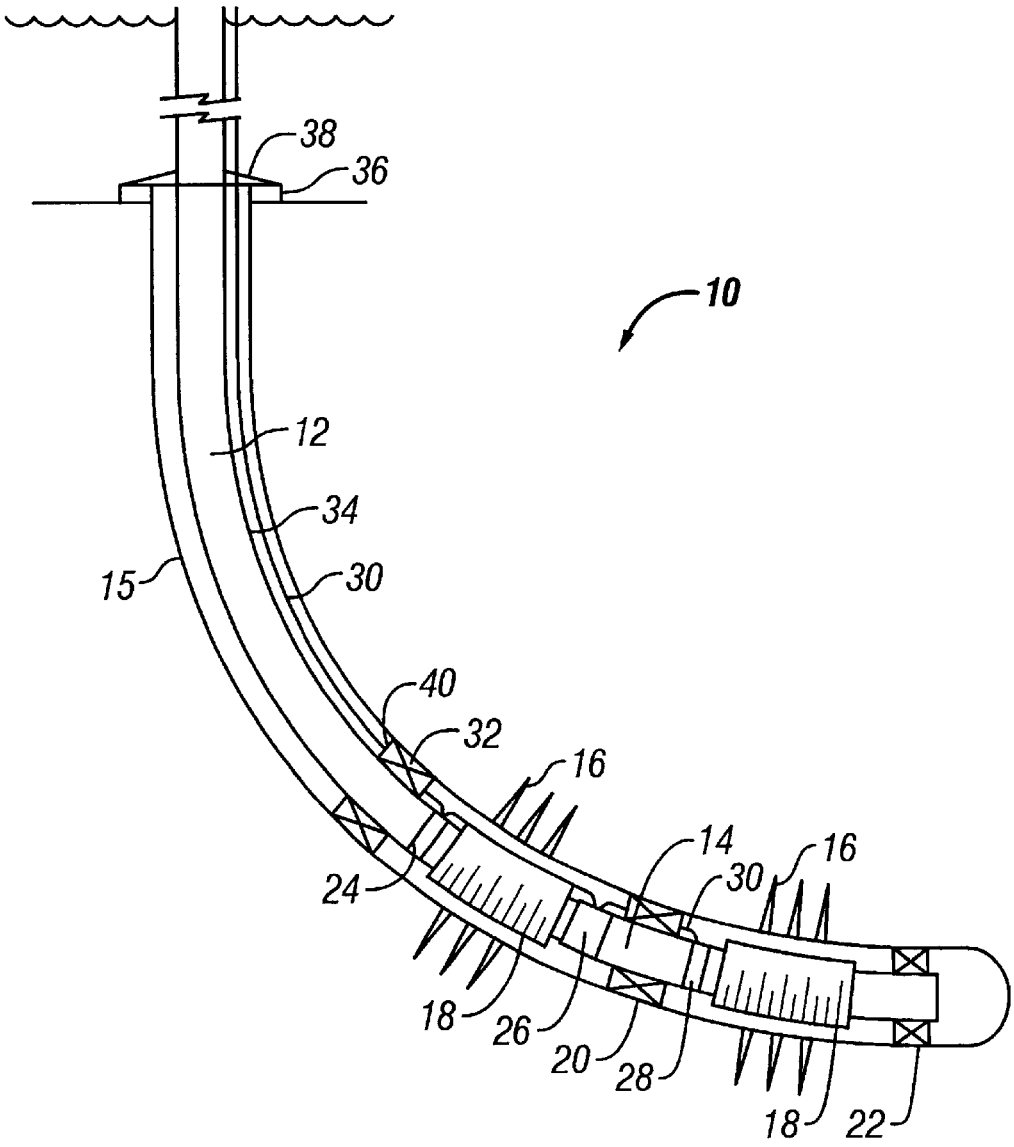
FIG. 1 illustrates schematically an embodiment of the present invention showing the upper and lower completions.

FIG. 1 shows a sample completion 10 that has an upper completion 12 and a lower completion 14 in a well 15. The lower completion 14 in the example has two isolated zones 16, although more may be completed. In addition, although the completion is shown as a sand control completion, other types of completions may be used. As an example, the completion could be some other form of two stage completion. Each zone is completed with a sand screen 18 and the zones are separated by an isolation packer 20. A sump packer 22 at the bottom of the completion isolates the lowest zone from the rathole. Within the zones of the example lower completion 14 are various intelligent completion devices 24, 26, 28 communicating with the surface via a control line 30. Examples of control lines are electrical, hydraulic, fiber optic and combinations of thereof. Note that the communication provided by the control lines 30 may be with downhole controllers rather than with the surface and the telemetry may include wireless devices and other telemetry devices such as inductive couplers and acoustic devices. An upper packer 32 isolates the uppermost zone.

As examples, the intelligent completions devices may comprise gauges, sensors, valves, sampling devices, a device used in intelligent or smart well completion, temperature sensors, pressure sensors, flow-control devices, flow rate measurement devices, oil/water/gas ratio measurement devices, scale detectors, actuators, locks, release mechanisms, equipment sensors (e.g., vibration sensors), sand detection sensors, water detection sensors, data recorders, viscosity sensors, density sensors, bubble point sensors, pH meters, multiphase flow meters, acoustic sand detectors, solid detectors, composition sensors, resistivity array devices and sensors, acoustic devices and sensors, other telemetry devices, near infrared sensors, gamma ray detectors, $H_2S$ detectors, $CO_2$ detectors, downhole memory units, downhole controllers, and locators. In addition, the control line itself may comprise an intelligent completions device as in the example of a fiber optic line that provides functionality, such as temperature measurement, pressure measurement, and the like.

The annulus around the sand screens 18 may be gravel packed using conventional techniques and equipment. For example, once the lower completion 14 is set in place, a service string may be run into the well to gravel pack the annulus. In other embodiments, a gravel pack is not used. Likewise, the well may be fractured, stimulated, or treated with some other well treatment. As previously mentioned, although the completion is shown as a sand control completion, other types of completions may be used and the present application is not limited to a sand control completion. As an example, the completion could be some other form of two stage completion. For instance, it could have a flow control valve between two packers.

The upper completion 12 comprises a production tubing 34 that extends from the upper packer 32 to the surface. The tubing 34 is supported on the wellhead 36 by a tubing hanger 38. The control line 30 extends along the production tubing 34 to the surface in the embodiment shown. Note that the upper completion 12 may have many other components not shown in the schematic of FIG. 1 (e.g., intelligent completion devices, safety valves, pumps, etc.).

In the embodiment used for discussion of the space-out method, the connection of the control line 30 of the upper completion 12 to the control line 30 of the lower completion 14 is made using a wet connect 40. In general, a wet connect is a connection, such as an electrical connection, a fiber optic connection, or a hydraulic connection that is made downhole as opposed to being made at the surface. In this case, the connection 40 is made downhole to facilitate the placement of the lower completion 14 into the well before the upper completion 12. In one embodiment, this is useful to allow for conventional gravel packing techniques using a service string that is pulled from the well before introduction of the production string of the upper completion. It is generally considered impractical to have a continuous control line 30 from the surface to the equipment below the upper packer 32 in such a case because the risk of damaging the control line 30 while making multiple trips with different strings is too great.

Figure 2:
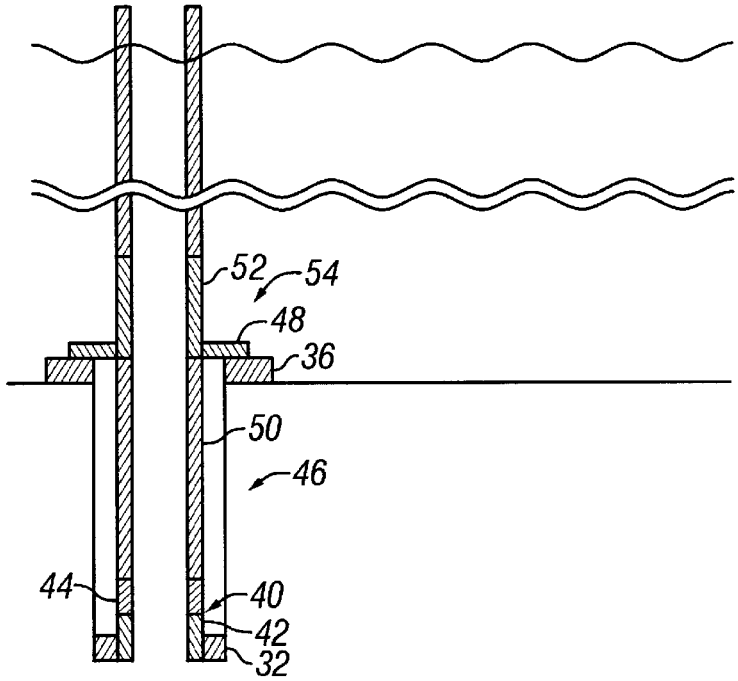
FIGS. 2 through 5 illustrate schematically an embodiment of the method for obtaining proper space-out of the present invention.

In one embodiment of the present invention, a first completion assembly, the lower completion 14, is placed in the well. As discussed above, the lower completion 14 comprises, for example, a packer and packer extensions (e.g., circulating housing, safety shear joint, screens, intelligent completions devices, etc.) as well as a control line 30 (e.g., fiber optic, electrical). As shown in FIG. 2, the lower completion 14 also comprises a lower wet connect assembly 42 at its upper end. The schematic of FIG. 2 shows only the top portion of the lower completion 14. The lower wet connect 42 is used to make up the connection to an upper wet connect assembly 44 of the connection 40.

The lower completion 14 is generally run at the bottom of a service string, which is pulled from the hole when the necessary operations (e.g., setting the packer, gravel packing, etc.) have been performed. In one embodiment of the present invention, the typical service string is replaced with a dummy production string 46 that is very similar to (1) the final production string, (2) the upper completion 12 which contains the tubing hanger and (3) the upper wet connect assembly 44. However, in the dummy service string 46, the completion jewelry (e.g., intelligent completion devices, valves, nipples, tubing hanger, wet connect) is replaced by pup joints having substantially the same length as the completion jewelry. In some embodiments the pup joints also have other characteristics, such as diameter, wall thickness, materials, and the like, that are the same as the replaced completion jewelry.

Figure 3:
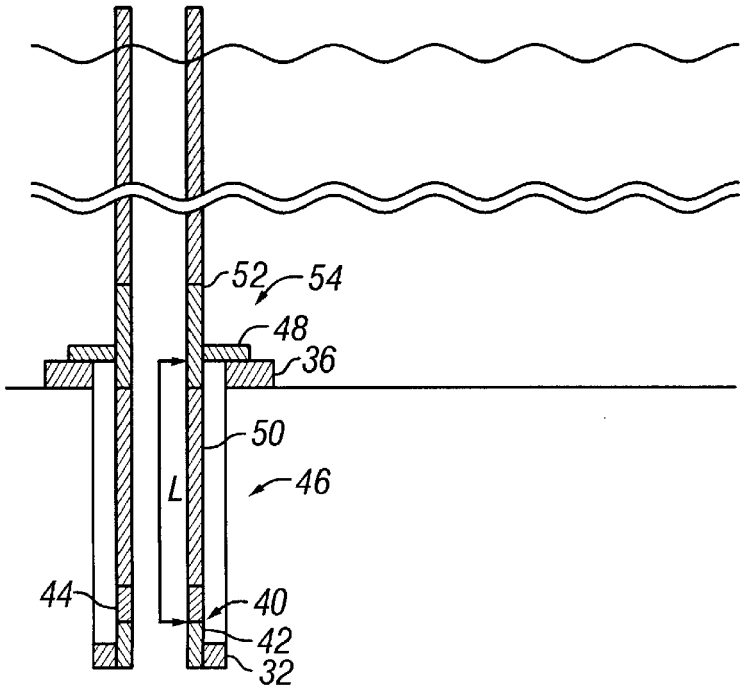

In one embodiment, the dummy production string 46 also comprises a measurement device 48 that surrounds the tubing of the dummy production string 46. Note that other devices that do not surround the tubing or comprise a "ring" may replace the ring 48. For example, a device may be mounted to one side of the dummy production string 46. For ease of description, the term "ring" is used to refer to a type of device that is moveable on the string 46 and not to a device having a ring shape necessarily. The term "measurement device" is used herein interchangeably with the term "ring." The measurement device 48 is positioned at substantially the axial location of the dummy production string 46 that would be occupied by the lower part of the tubing hanger assembly 38 in the upper completion 12. The axial position of the measurement device 48 is releasably maintained using a shear mechanism, such as a shear pin. Other manners of maintaining the axial position, such as the use of release mechanisms (e.g., dogs, collets, solenoids, sleeves, ratchet teeth) that operate in response to mechanical, electrical, or hydraulic action, may be used in the place of the shear mechanism. As the dummy production string 46 is run into the well 15, the measurement device 48 will no-go on the wellhead as shown in FIG. 2 (which may indicate the proper setting position for the packer 32). At this point in the running operation, before the packer 32 is set, the dummy production string 46 is in tension with the weight of the equipment supported by the tubing 50. After setting the packer, the amount of weight required for the wet connect 40 to work (i.e., to properly connect) is applied onto the dummy production string 46 causing the shear mechanism to shear and release the measurement device 48 from the tubing. The tubing 50 is now free to slide through the measurement device 48 that is restricted from further downward movement by the wellhead 36. Thus, the dummy production string 46 is placed in compression with the set-down weight applied. FIG. 3 schematically shows the dummy production string 46 in the set-down, compressed condition and the measurement device 48 positioned relatively higher on the tubing 50. The difference in the position of the measurement device 48 with respect to the tubing 50 is due to the change in length of the tubing 50 when the load of the tubing changes from tension (FIG. 2) to compression (FIG. 3). Note that some desired point on the dummy production string 46, other than the position of the tubing hanger 38, can be measured with the technique of the present invention. For example, a point one meter above the tubing hanger position could be measured.

Figure 4:
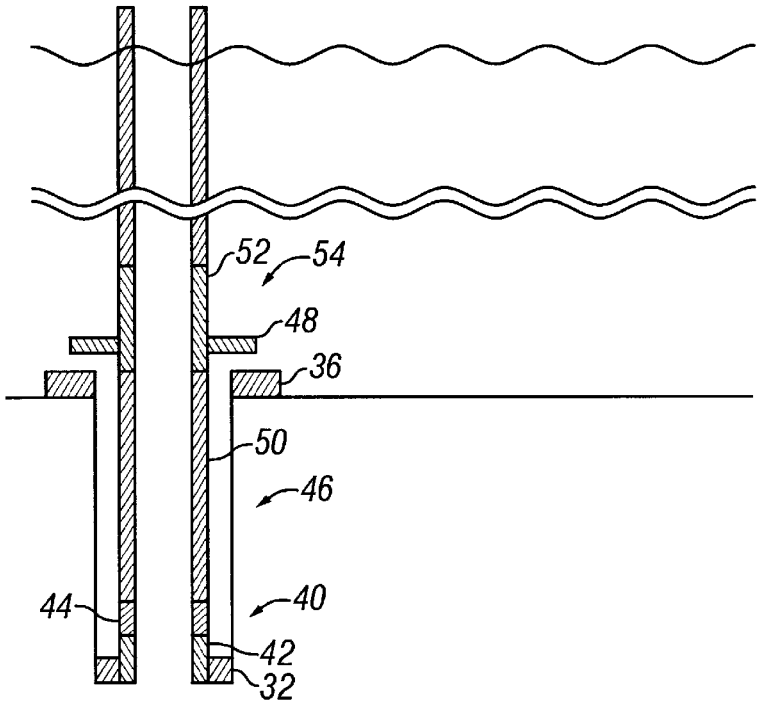

The dummy production string 46 further comprises a position lock 52. The position lock 52 cooperates with the measurement device 48 allowing the measurement device to move upward relative to the tubing 50, but not allowing the measurement device 48 to move downward with respect to the tubing 50. In one exemplary embodiment, the position lock 52 is a ratchet mechanism, such as ratchet teeth, formed on the tubing 50 that cooperate with a mating ratchet member on the measurement device 48. An alternative embodiment of the position lock 52 is a friction device that relies on friction to hold the measurement device in place. So that, when the dummy production string 46 is pulled from the well as shown in FIG. 4, the distance "L" of FIG. 3, which is the correct and proper distance between the tubing hanger and the wet connect, is accurately measured and known. When the dummy production string 46 is pulled from the well 15, the distance is accurately determined because the position of the measurement device 48 is locked with respect to the tubing. As the service string is removed from the hole, the length (L) is measured on the rig floor, and the actual completion string, with the correct space-out and the completion jewelry is then run in the hole. Accordingly, the measurement device 48 and associated equipment may be referred to generally as a sliding measurement device 54.

In an alternative embodiment, the measurement device 48 and associated equipment is omitted. The relative positions between the tension position and the set-down compressed positions are instead measured in some other manner (e.g., by marking the tubing). Thus, in one example, the dummy production string 46 in the set-down, compressed condition and the tubing 50 is marked to indicate the desired position that the hanger 38.

Figure 5:
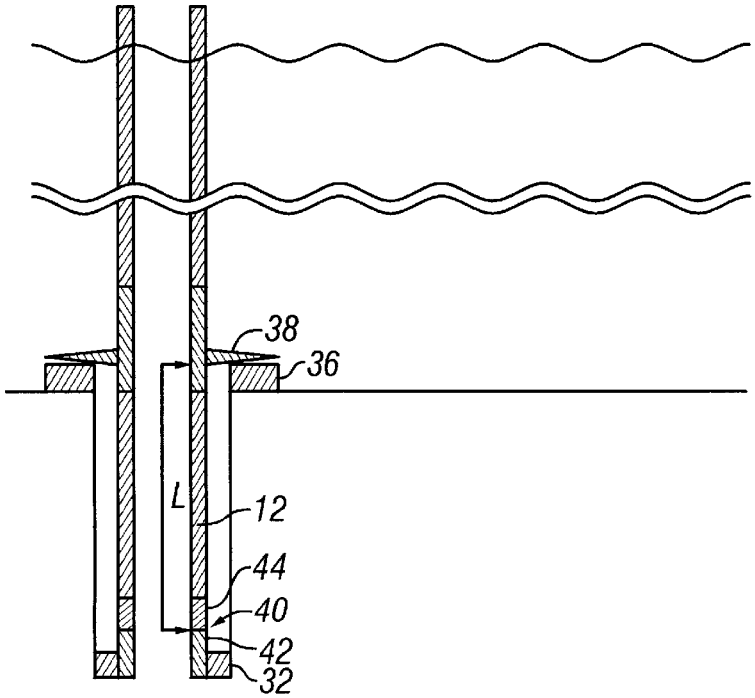

As the tubing hanger 38 lands on the wellhead 36 (FIG. 5), the space-out between the tubing hanger 38 and the wet connect 40 is such that the appropriate weight may be set onto the wet connect 40.

In some applications where high changes in temperature are expected during the life of the well, the upper part of the completion (above the wet connect) may contain an additional anchor placed close to the wet connect 40. Such an anchor may ensure that enough weight would be applied onto the wet connect throughout the life of the well.

Note that the example of the wet connect is one of many possible applications for the space-out method which may be used to accurately space out other equipment in the well. For example, the space out method may be used in two stage completions as well as other completions and situations. Similarly, although the above description primarily describes a sand control completion, the space out method of the present invention may be applied to other types of completions.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112, paragraph 6 for any limitations of any of the claims herein, except for those in which the claim expressly uses the words 'means for' together with an associated function.

I claim:

1. A method for accurately spacing out equipment in a well, comprising running a lower completion into a well on a dummy production string, the dummy production string having a pup joint in the place of a completion jewelry of a final production string.

2. The method of claim 1, further comprising the pup joint having one or more of a length, a diameter, a wall thickness, and a material, that is similar to that of the replaced completion jewelry.

3. The method of claim 1, further comprising:

applying a set-down weight on the dummy production string; and then measuring the length of the dummy production string.

4. The method of claim 1, further comprising sliding a measurement device along the dummy production string to indicate a desired point on the dummy production string.

5. The method of claim 1, further comprising:

measuring the length of the dummy production string;

removing the dummy production string from the well;

assembling the final production string using the measurement from the measuring step; and running the final production string into the well.

6. The method of claim 1, further comprising completing a wet connect when running the final production string.

7. The method of claim 1, further comprising:

positioning a measuring device at a first position on the dummy production string;

applying a set down weight to the dummy production string;

moving the measuring device to a second position; and the distance between the first and second positions representative of the change in the length of the dummy production string when the load on the dummy production string changes from tension to compression.

8. A method for accurately spacing out equipment in a well, comprising:

running a lower completion into the well on a dummy production string having a sliding measurement device;

removing the dummy production string from the well;

measuring the space-out distance using the sliding measurement device;

assembling and running an upper completion string into the well.

9. The method of claim 8, further comprising releasably restraining the measurement device during the running step.

10. The method of claim 8, further comprising completing a wet connect between the upper completion string and the lower completion.

11. The method of claim 10, further comprising providing an anchor in the upper completion string above the wet connect.

12. The method of claim 8, further comprising applying a set-down weight to the dummy production string.

13. An apparatus for use in measuring the proper space out distance for equipment in a well, comprising a running string having a sliding measurement device;

a pup joint of the running string having a characteristic that is similar to that of a characteristic of an upper completion string;

the characteristic selected from the group consisting of a length, a diameter, a wall thickness, and a material.

14. The apparatus of claim 13, further comprising a release mechanism connecting the sliding measurement device to the running string.

15. The apparatus of claim 14, where in the release mechanism is selected from the group consisting of a shear pin, a dog, a collet, a solenoid, a sleeve, and a set of ratchet teeth.

16. The apparatus of claim 13, further comprising a position lock connecting the sliding measurement device to the running string.

17. The apparatus of claim 16, wherein the position lock is selected from the group consisting of a friction device and a ratchet mechanism.

* * * * *